US006604556B1

(12) United States Patent
Huss et al.

(10) Patent No.: US 6,604,556 B1
(45) Date of Patent: Aug. 12, 2003

(54) CONTAINER WITH CONICAL-SHAPED RAMP AND METHOD OF REMOVING PARTICLES FROM THE SAME

(75) Inventors: Timothy L. Huss, Ontario, NY (US); William R. Enderle, Jr., Rochester, NY (US); Dale E. Boudreau, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/230,633

(22) Filed: Aug. 28, 2002

(51) Int. Cl.[7] ..... B65B 1/04
(52) U.S. Cl. ..... 141/65; 141/331
(58) Field of Search ..... 141/65, 331, 114, 141/98, 66, 70; 220/495.06, 527, 528, 529

(56) References Cited

U.S. PATENT DOCUMENTS 3,384,106 A * 5/1968 Isbrandtsen ..... 137/269
3,422,985 A * 1/1969 Rinehart ..... 4/484
4,068,689 A * 1/1978 Krull ..... 141/93
4,280,528 A * 7/1981 Soderstrom ..... 137/408
5,398,733 A * 3/1995 Welch ..... 141/4
6,223,012 B1 4/2001 Kumar et al. ..... 399/258

* cited by examiner

*Primary Examiner*—Steven O. Douglas
(74) *Attorney, Agent, or Firm*—Wayne J. Egan

(57) ABSTRACT

Particles are packed in a container. The container is either cylindrical-shaped or box-shaped. The container has a container inner wall and an inner bottom. A ramp is disposed on the container inner bottom. The ramp has a ramp base that is narrower than the container inner bottom. A conical-shaped inclined ramp surface extends upward from the ramp base at a substantially constant ramp surface angle with respect to horizontal and towards the container inner wall. The inclined ramp surface defines a ramp upper rim that is substantially proximate to the container inner wall. The particles have an angle of repose that is less than the ramp surface angle. The particles flow down the inclined ramp surface towards the ramp base. The particles are removed from the container using a vacuum feed nozzle that is disposed proximate to the particles in the container.

22 Claims, 4 Drawing Sheets

CONTAINER WITH CONICAL-SHAPED RAMP AND METHOD OF REMOVING PARTICLES FROM THE SAME

BACKGROUND OF THE INVENTION

It is known to pack particles in a container. For example, it is known to ship plastic resin particles in a large bulk box-shaped container or toner carrier particles in 55-gallon cylindrical-shaped drum container.

It is also known to use a vacuum feed nozzle to remove such particles from the container. For example, at the internet web address "www.piab.com" there is provided information of various "vacuum conveyor" products available from the Swedish supplier PIAB AB, whose mailing address is P.O. Box 4501, SE-183 04 Täby, Sweden.

However, there are problems with this vacuum-feed-nozzle process of removing particles from cylindrical-shaped containers or box-shaped containers. For example, assume that containers are initially only 50% filled with about 700 pounds of plastic resin or toner carrier. When the level in the drum gets down to the last 3 or 4 inches, with 150 pounds of plastic resin particles or toner carrier particles still remaining in the container, the nozzle will clear a hole around itself and no longer pick up material. To get the last 25% of plastic resin or toner carrier particles out of the container an operator must manually manipulate the nozzle every couple minutes until the level is low or light enough that the container liner bag can be picked up and dumped into another open container. The extra manpower required for attending the nozzle is a problem and frequent cause of downtime. Also as operators are attending the feed nozzle and dumping bags, there might be a safety hazard presented to the human operators, as the humans might be exposed to health hazards such as, for example, inhaling harmful material or fumes related to the plastic resin or toner carrier. For example, recently a human operator was diagnosed with a lung inflammation condition named "interstitial pneumonitus" caused by toner carrier particles entering his lungs.

There are several existing methods to solve the problem of having to attend to the feed nozzle but these methods are more costly, complex, require more floor space, and create other safety hazards. A method, as used in several plants, is conveying out of a fixed carrier supply hopper that holds 3–5 containers of carrier. The hoppers used are loaded by a dedicated container dumper. Special perimeter guarding and safety mats are required around the container dumper because when the drum is lifted into the air serious hazards exist under and near it. In another plant a fork truck using a special container handling attachment dumps the carrier into a supply hopper. There are dedicated hoppers and container dumpers for each pack line and sometimes for each carrier type, thus requiring a large amount of floor space. An other existing method is to place the drum onto a container tilter. The carrier flows toward the corner of the tilted container where the nozzle is located allowing almost all the carrier to be sucked out without manipulation of the nozzle. This method works well but the container tilter device takes up a minimum of 20 square feet of floor space. Also, when the container is tipped there is a hazardous area underneath that must be guarded in some way, thus taking more floor space. Another drawback to using the tilter is the container must be handled requiring a fork truck with a special attachment to lift the container off the skid and place it on the drum tilter.

Moreover, this problem is currently addressed by adding capital equipment such as container tilters, fork truck container handling tools, container dumpers, and supply hoppers. This equipment adds complexity and cost, increases material handling of the drums and plastic resin particles or toner carrier particles, creates new safety hazards and spill risks, and requires a much larger floor space.

SUMMARY OF THE INVENTION

In one aspect of the invention, there is described a container having a container inner wall, a container inner bottom with a ramp disposed thereon, the ramp having an included ramp base that is narrower than the container inner bottom, the ramp forming a conical-shaped inclined ramp surface that extends upwardly from the ramp base at a substantially constant ramp surface angle with respect to horizontal towards the container inner wall, the inclined ramp surface defining a ramp upper rim that is substantially proximate to the container inner wall. In one embodiment, the container is cylindrical-shaped. In another embodiment, the container is box-shaped.

In another aspect of the invention, there is described a method of removing particles that are disposed in a container having a container inner wall, a container inner bottom with a ramp disposed thereon, the ramp having an included ramp base that is narrower than the container inner bottom, the ramp forming a conical-shaped inclined ramp surface that extends upwardly from the ramp base at a substantially constant ramp surface angle with respect to horizontal towards the container inner wall, the inclined ramp surface defining a ramp upper rim that is substantially proximate to the container inner wall, the particles having an angle of repose that is less than the ramp surface angle and flow down the inclined ramp surface towards the ramp base, the method comprising removing particles using a vacuum feed nozzle that is disposed proximate to the particles in the container. In one embodiment, the container is cylindrical-shaped. In another embodiment, the container is box-shaped.

BRIEF DESCRIPTION OF THE SEVERAL VIEWS OF THE DRAWINGS

FIG. 3 also depicts a vacuum conveyor device such as, for example, a vacuum feed nozzle 50. In accordance with the present invention, FIG. 3 also depicts the feed nozzle 50 being used to remove the particles 40 from the container 10.

FIG. 4 also depicts a vacuum feed nozzle 50 being used to remove the particles 40 from the box-shaped container 100.

DETAILED DESCRIPTION OF THE INVENTION

Briefly, particles are packed in a container. In one embodiment, the container is cylindrical-shaped. In another embodiment, the container is box-shaped. The container has a container inner wall and an inner bottom. A ramp is disposed on the container inner bottom. The ramp has a ramp base that is narrower than the container inner bottom. A conical-shaped inclined ramp surface extends upward from the ramp base at a substantially constant ramp surface angle with respect to horizontal and towards the container inner wall. The inclined ramp surface defines a ramp upper rim that is substantially proximate to the container inner wall. The particles have an angle of repose that is less than the ramp surface angle. The particles flow down the inclined ramp surface towards the ramp base. The particles are removed from the container using a vacuum feed nozzle that is disposed proximate to the particles in the container.

Figure 1:
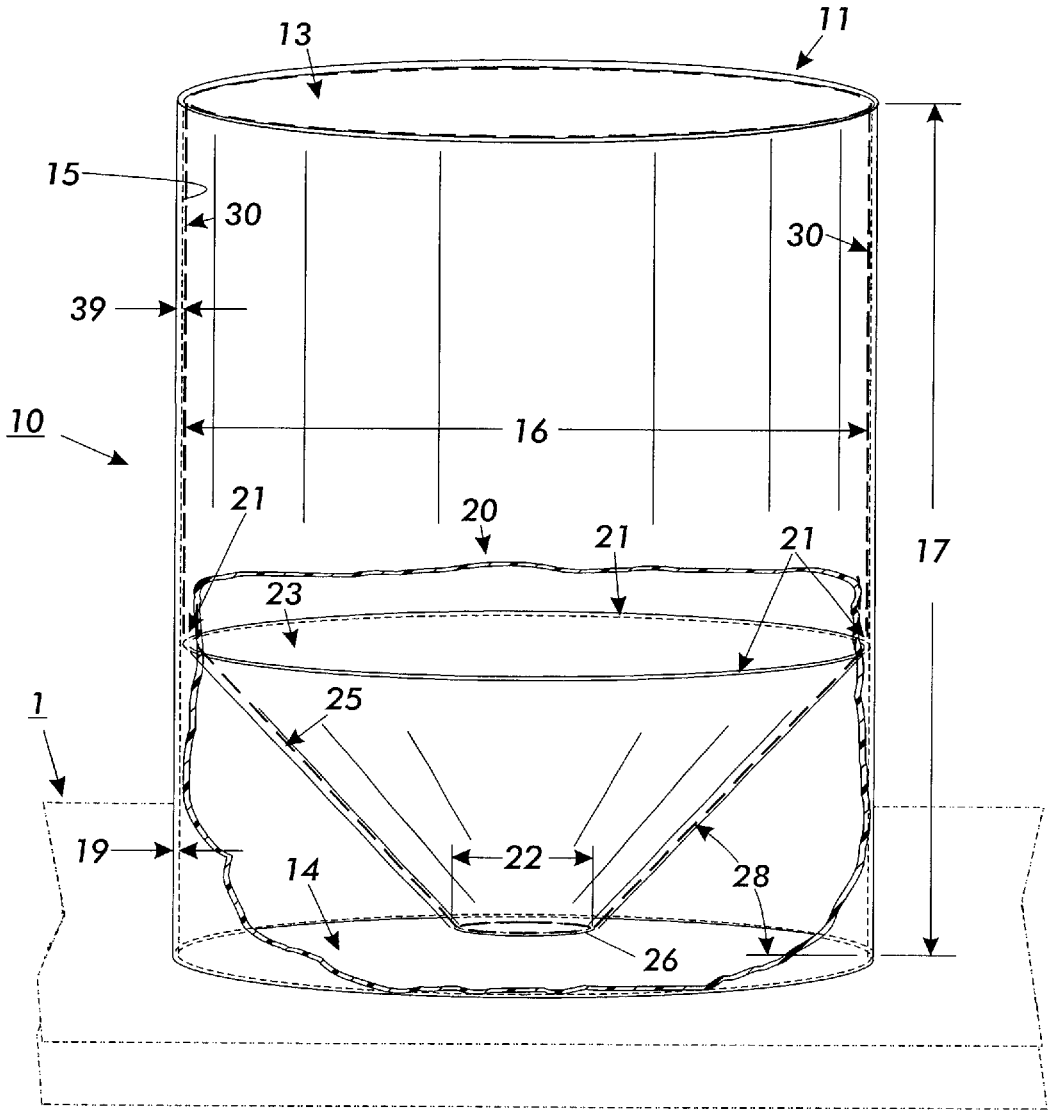
FIG. 1 is a cutaway, cross-section view of a cylindrical-shaped container 10 with a conical-shaped ramp 20, in accordance with the present invention. Also depicted is a horizontal reference line 1.

Referring now to FIG. 1 there is depicted a barrel-shaped or cylindrical-shaped container 10 having a concave, curved container inner wall 15, a circular-shaped container inner bottom 14 with a conical-shaped ramp 20 disposed thereon, the ramp 20 having an included circular-shaped ramp base 22 that is narrower than the container inner bottom 14. As shown, the ramp 20 forms a conical-shaped inclined ramp surface 25 that extends upwardly from the ramp base 22 at a substantially or generally constant ramp surface angle 28 with respect to horizontal 1 towards the container inner wall 15. As depicted in FIG. 1, the inclined ramp surface 25 defines a circular-shaped ramp upper rim or ramp lip 21 that is substantially congruent with or proximate to the container inner wall 15.

In one embodiment, the conical-shaped ramp 20 is detachable from the container inner bottom 14.

In another embodiment, the conical-shaped ramp 20 is fixed to the container inner bottom 14.

Still referring to FIG. 1, in one embodiment the container 10 includes a liner 30 (shown in broken lines) disposed on the inclined ramp surface 25, and also on the container inner wall 15. In one embodiment, the liner 30 comprises a plastic or polyurethane bag.

Figure 2:
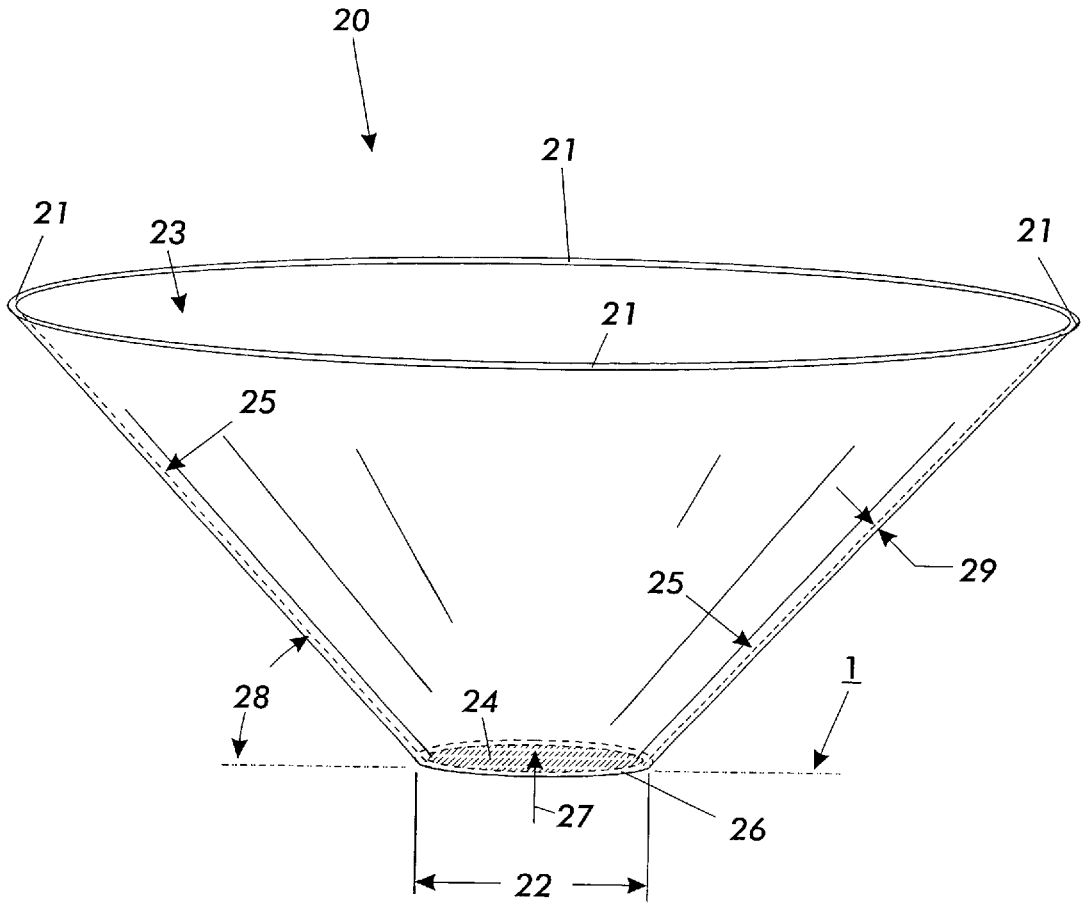
FIG. 2 depicts one embodiment of the conical-shaped ramp 20.

The ramp 20 is separately depicted in FIG. 2. Referring now to FIG. 2, the conical-shaped inclined ramp surface 25 depicted therein forms a rounded or circular-shaped ramp lower rim or ramp lower lip 26 which, in turn, forms the circular-shaped ramp base 22. The ramp base 22, in turn, is disposed on the container inner bottom 14 of the container 10.

In one embodiment, the ramp lower rim 26 is open, thereby defining a ramp lower opening 27.

In another embodiment, the ramp lower rim 26 is enclosed, thereby forming a ramp inner bottom 24.

It will be appreciated that the shape of the cone-shaped ramp 20 may be characterized as a frustum of a cone.

In one embodiment, the ramp 20 is fabricated from a metal such as, for example, a spun stainless steel of having a ramp material thickness 29 of 1/16 inch or 40 mil.

In another embodiment, the ramp 20 is fabricated from a plastic.

In still another embodiment, the ramp 20 is fabricated from a fiberglass.

Returning again to FIG. 1, in one embodiment the container 10 comprises a 55-gallon size drum which may be fabricated, for example, from steel.

Also, in one embodiment, the circular-shaped or round lower rim 26 comprises a ramp base 22 of about 3 inches in diameter.

In one embodiment, the ramp surface angle 28 is about 45 degrees.

In one embodiment, the ramp upper rim 21 is about 22 inches in diameter.

Figure 3:
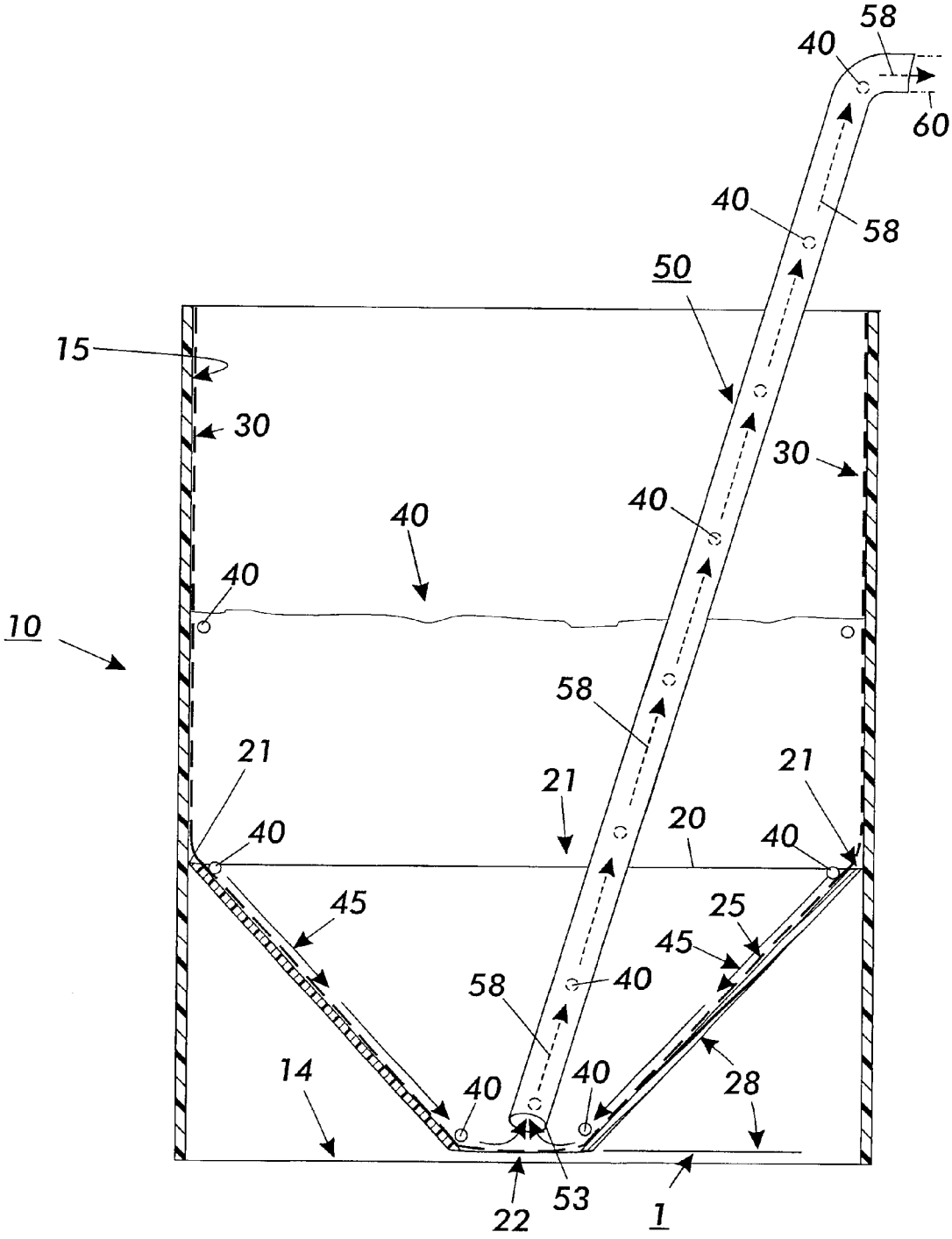
FIG. 3 depicts the cylindrical-shaped container 10 with the conical-shaped ramp 20, including particles 40 being disposed therein.

Referring now to FIG. 3, there is depicted the container 10 with the conical-shaped ramp 20, the container 10 including particles 40 disposed therein. In one embodiment, the particles are free flowing, granular or powder.

FIG. 3 also depicts a vacuum conveyor device such as, for example, a vacuum feed nozzle 50. The vacuum feed nozzle 50 includes a vacuum nozzle mouth or opening 53 that is positioned proximate to the ramp base 22. As shown, a vacuum force 58 that is supplied by the vacuum feed nozzle 50 causes particles 40 that are proximate to the vacuum nozzle mouth 53 to initially move towards the nozzle mouth 53 and thereafter to be conveyed within the vacuum feed nozzle 50 to a vacuum particle conveyor 60.

In one embodiment, the particles 40 have diameters that vary from 5 microns to 2 millimeters.

In one embodiment, the particles 40 comprise a plastic resin.

In another embodiment, the particles 40 comprise a toner carrier.

In accordance with the present invention, FIG. 3 also depicts the vacuum feed nozzle 50 being used to remove the particles 40 from the container 10. Thus, there is depicted in FIG. 3 a method of removing particles 40 that are disposed in a cylindrical-shaped container 10 having a container inner wall 25, a container inner bottom 14 with a ramp 20 disposed thereon, the ramp 20 having an included ramp base 22 that is narrower than the container inner bottom 14, the ramp 20 forming a conical-shaped inclined ramp surface 25 that extends upwardly from the ramp base 22 at a substantially constant ramp surface angle 28 with respect to horizontal 1 towards the container inner wall 15, the inclined ramp surface 25 defining a ramp upper rim 21 that is substantially proximate to the container inner wall 15, the particles 40 having an angle of repose that is less than the ramp surface angle 28 so that particles 40 flow (depicted by reference number 45) down the inclined ramp surface 25 towards the ramp base 22, the method comprising removing particles 40 located proximate to the ramp base 22 using a vacuum feed nozzle 50.

Still referring to FIG. 3, it will be understood that the particles 40 having an angle of repose that is less than the ramp surface angle 28 is equivalent to the ramp surface angle 28 exceeding the angle of repose of the particles 40.

Still referring to FIG. 3, in one embodiment the container 10 includes a liner 30 (depicted in broken lines) disposed on the inclined ramp surface 25.

Figure 4:
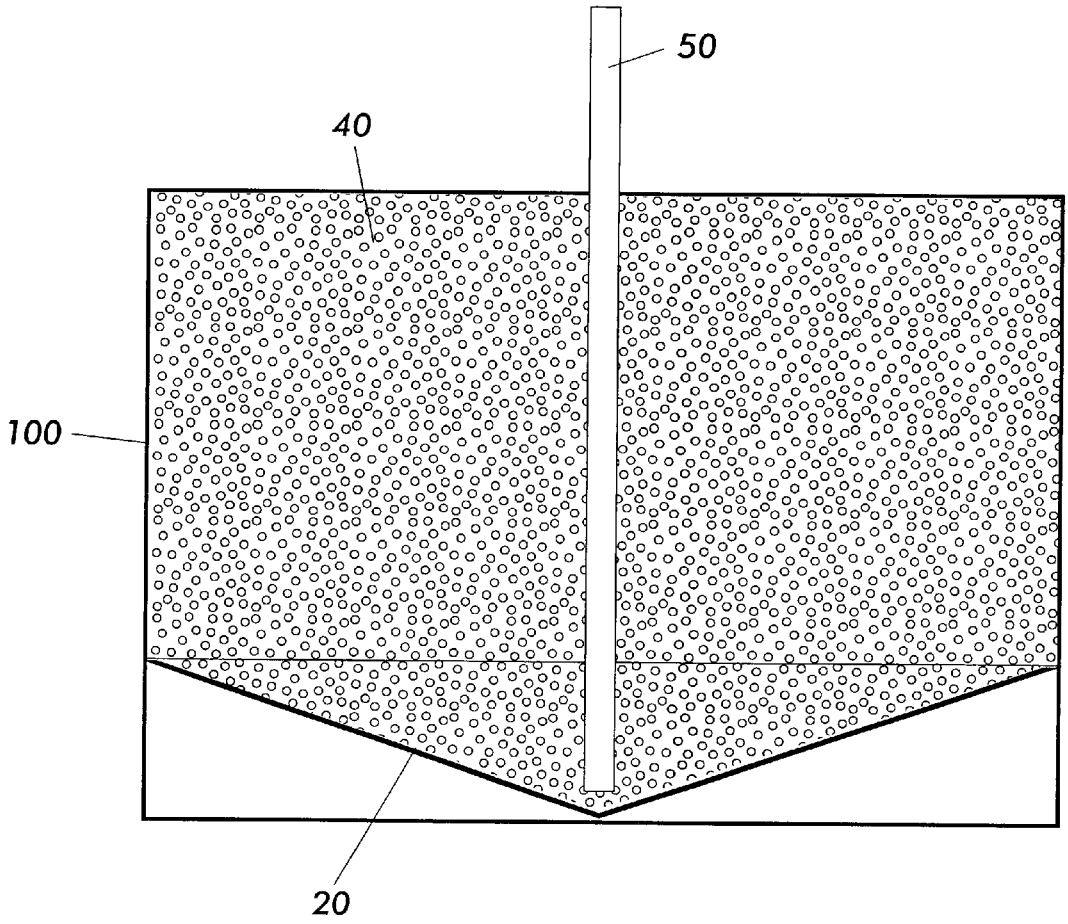
FIG. 4 depicts a cutaway, cross-section view of a box-shaped container 100 with a conical-shaped ramp 20, in accordance with the present invention, including particles 40 being disposed therein.

Referring now to FIG. 4, there is depicted a box-shaped container 100 with a conical-shaped ramp 20, in accordance with the present invention, including particles 40 being disposed therein. FIG. 4 also depicts a vacuum feed nozzle 50 being used to remove the particles 40 from the box-shaped container 100.

Thus, there has been described a container, the container comprising either the cylindrical-shaped container 10 depicted in FIG. 1 or the box-shaped container 100 depicted in FIG. 4, having a container inner wall, a container inner bottom with a ramp 20 disposed thereon, the ramp 20 having an included ramp base that is narrower than the container inner bottom, the ramp 20 forming a conical-shaped inclined ramp surface that extends upwardly from the ramp base at a substantially constant ramp surface angle with respect to horizontal towards the container inner wall, the inclined ramp surface defining a ramp upper rim that is substantially proximate to the container inner wall.

Further, there has also been described a method of removing particles that are disposed in a container, the container comprising either the cylindrical-shaped container 10 depicted in FIG. 1 or the box-shaped container 100 depicted in FIG. 4, having a container inner wall, a container inner bottom with a ramp 20 disposed thereon, the ramp 20 having an included ramp base that is narrower than the container inner bottom, the ramp 20 forming a conical-shaped inclined ramp surface that extends upwardly from the ramp base at a substantially constant ramp surface angle with respect to horizontal towards the container inner wall, the inclined ramp surface defining a ramp upper rim that is substantially proximate to the container inner wall, the particles having an angle of repose that is less than the ramp surface angle and flowing down the inclined ramp surface towards the ramp base, the method comprising removing particles using a vacuum feed nozzle that is disposed proximate to the particles in the container.

In summary, in one embodiment, the invention comprises a conical-shaped ramp insert placed in the inner bottom of a cylindrical-shaped container or a box-shaped container. The plastic resin particles or toner carrier particles and vacuum feed nozzle flow or slide by gravity to the center of the drum for easy material pick up. In one embodiment, the conical ramp insert has a 45 degree side wall and is made from metal, plastic, or fiberglass. Since the containers are lined with a heavy plastic bag, the conical ramp insert does not require a tight seal to the inside of the drum. Or, in another embodiment, a rubber seal is used to fit the conical ramp insert to the inside of the container. At the plastic resin or toner carrier supplier the ramp insert is placed in a standard container, then the bag, then the plastic resin particles or toner carrier particles are filled. Later, at the plant, all the plastic resin or toner carrier is sucked out without operator intervention, the bag is removed, and the conical ramp insert is removed. The conical ramp inserts can nest and are stacked up on a skid for return to the plastic resin or toner carrier supplier. A variation of this invention is to weld the insert into place in the container's inner bottom. This latter variation may be beneficial for plants that fill the plastic resin or toner carrier container on site, have a container return program in place, or do not use a container liner bag.

As a result, this invention will eliminate the manpower, downtime and associated hazards currently required to manually manipulate the plastic resin particles or toner carrier particles vacuum feed nozzle. By using this invention, a plant may continue to use the simplistic method of sucking plastic resin particles or toner carrier particles straight from the plastic resin or toner carrier container, thus avoiding the addition of capital equipment, complexity, and safety or spill risks for container tilters, supply hoppers, container dumpers, and special fork truck attachments. This method thus minimizes floor space requirements and container and material handling. This method minimizes changeovers, as there are no hoppers to clean.

In one embodiment, the container is a cylindrical-shaped drum. In another embodiment, the container is a large bulk box-shaped container.

The table below lists the drawing element reference numbers together with their corresponding written description:

| Reference number: | Description: |
|---|---|
| 1 | horizontal reference line |
| 10 | cylindrical-shaped container |
| 11 | container upper rim |
| 13 | container mouth, or container opening |
| 14 | container inner bottom |
| 15 | container inner wall |
| 16 | container inner diameter |
| 17 | container height |
| 19 | container material thickness |
| 20 | ramp |
| 21 | ramp upper rim, or ramp upper lip |
| 22 | ramp base |
| 23 | ramp upper mouth, or ramp upper opening |
| 24 | ramp inner bottom |
| 25 | ramp surface |
| 26 | ramp lower rim, or ramp lower lip |
| 27 | ramp lower mouth, or ramp lower opening |
| 28 | ramp surface angle |
| 29 | ramp material thickness |
| 30 | liner |
| 39 | liner material thickness |
| 40 | particles |
| 45 | flow of particles down the ramp surface |
| 50 | vacuum feed nozzle |
| 53 | vacuum nozzle mouth, or vacuum nozzle opening |
| 58 | vacuum force |
| 60 | vacuum particle conveyor |
| 100 | box-shaped container |

While various embodiments of a container with a conical-shaped ramp and a method of removing particles from the same, in accordance with the present invention, are described above, the scope of the invention is defined by the following claims.

What is claimed is:

1. A container having a container inner wall, a container inner bottom with a ramp disposed thereon, the ramp having an included ramp base that is narrower than the container inner bottom, the ramp forming a conical-shaped inclined ramp surface that extends upwardly from the ramp base at a substantially constant ramp surface angle with respect to horizontal towards the container inner wall, the inclined ramp surface defining a ramp upper rim that is substantially proximate to the container inner wall.

2. The container of claim 1 being cylindrical-shaped.

3. The container of claim 1 being box-shaped.

4. The container of claim 1, the ramp being detachable from the container inner bottom.

5. The container of claim 1, including a liner disposed on the ramp surface.

6. The container of claim 5, the liner comprising a plastic bag.

7. The container of claim 1, the ramp being fabricated from a metal.

8. The container of claim 1, the ramp being fabricated from a plastic.

9. The container of claim 1, the ramp being fabricated from a fiberglass.

10. The container of claim 1, the container comprising a 55-gallon drum.

11. The container of claim 10, the ramp surface angle being about 45 degrees.

12. The container of claim 10, the ramp upper rim of about 22 inches in diameter.

13. The container of claim 1, including particles disposed therein.

14. The container of claim 13, the particles being free flowing, granular or powder.

15. The container of claim 14, the particles having diameters of 5 microns to 2 millimeters.

16. The container of claim 13, the particles comprising a plastic resin.

17. The container of claim 13, the particles comprising a toner carrier.

18. A method of removing particles that are disposed in a container having a container inner wall, a container inner bottom with a ramp disposed thereon, the ramp having an included ramp base that is narrower than the container inner bottom, the ramp forming a conical-shaped inclined ramp surface that extends upwardly from the ramp base at a substantially constant ramp surface angle with respect to horizontal towards the container inner wall, the inclined ramp surface defining a ramp upper rim that is substantially proximate to the container inner wall, the particles having an angle of repose that is less than the ramp surface angle and flowing down the inclined ramp surface towards the ramp base, the method comprising removing particles using a vacuum feed nozzle that is disposed proximate to the particles in the container.

19. The method of claim 18, the container being cylindrical-shaped.

20. The method of claim 18, the container being box-shaped.

21. The method of claim 18, the particles comprising a plastic resin.

22. The method of claim 18, the particles comprising a toner carrier.

* * * * *